US010090582B2

(12) United States Patent
Nakane et al.

(10) Patent No.: US 10,090,582 B2
(45) Date of Patent: Oct. 2, 2018

(54) VEHICLE ATTACHED COMPONENT, AND ON-BOARD ANTENNA

(71) Applicants: Kojima Industries Corporation, Toyota-shi, Aichi (JP); TOYOTA JIDOSHA KABUSHIKI KAISHA, Toyota-shi, Aichi-ken (JP)

(72) Inventors: Shunsuke Nakane, Toyota (JP); Ryuji Ando, Toyota (JP); Tomiyasu Hirayama, Toyota (JP); Haruhiko Yoshida, Toyota (JP); Hiroki Osada, Toyota (JP); Jun Yuyama, Anjo (JP); Takayoshi Naemura, Okazaki (JP)

(73) Assignees: KOJIMA INDUSTRIES CORPORATION, Toyota-Shi, Aichi-Ken (JP); TOYOTA JIDOSHA KABUSHIKI KAISHA, Toyota-Shi, Aichi-Ken (JP)

( * ) Notice: Subject to any disclaimer, the term of this patent is extended or adjusted under 35 U.S.C. 154(b) by 186 days.

(21) Appl. No.: 14/780,831

(22) PCT Filed: Feb. 12, 2014

(86) PCT No.: PCT/JP2014/053169
§ 371 (c)(1),
(2) Date: Sep. 28, 2015

(87) PCT Pub. No.: WO2014/156347
PCT Pub. Date: Oct. 2, 2014

(65) Prior Publication Data

US 2016/0056534 A1 Feb. 25, 2016

(30) Foreign Application Priority Data

Mar. 28, 2013 (JP) ..... 2013-069661

(51) Int. Cl.
*H01Q 1/32* (2006.01)
*H01Q 1/12* (2006.01)
*H01Q 1/36* (2006.01)

(52) U.S. Cl.
CPC ..... *H01Q 1/32* (2013.01); *H01Q 1/12* (2013.01); *H01Q 1/3275* (2013.01); *H01Q 1/3291* (2013.01); *H01Q 1/36* (2013.01)

(58) Field of Classification Search
CPC .. H01Q 1/1271; H01Q 1/3275; H01Q 1/1278; H01Q 1/273; H01Q 1/44
(Continued)

(56) References Cited

U.S. PATENT DOCUMENTS 8,130,156 B2 3/2012 Kittinger et al.
2005/0012675 A1 1/2005 Sakiyama et al.
(Continued)

FOREIGN PATENT DOCUMENTS

CN 1599966 A 3/2005
CN 1874064 A 12/2006
(Continued)

OTHER PUBLICATIONS

Chinese Office Action corresponding to Application No. 2014800118844.7; dated Dec. 28, 2016.
(Continued)

*Primary Examiner* — Dameon E Levi
*Assistant Examiner* — Collin Dawkins
(74) *Attorney, Agent, or Firm* — Cantor Colburn LLP

(57) ABSTRACT

The purpose of the present invention is to enable a secure attachment of an antenna element and to facilitate adjustment of the antenna element characteristics. Rearward of a spoiler are formed a plurality of lateral grooves extending in a left-right direction of a vehicle, and a plurality of vertical grooves extending in a front-rear direction of the vehicle.
(Continued)

The plurality of lateral grooves and the plurality of vertical grooves form latticed grooves as grooves in the shape of a lattice for installing an antenna element. The antenna element is formed by a conductive wire. One end of the antenna element is connected to an amplifier, and the other end is opened. The antenna element extends from the amplifier via a power feeding groove and the right-end one of the vertical grooves to the rear end of the groove, from which the antenna element is fitted in a route along the most rearward one of the lateral grooves to the vicinity of the left-end one of the vertical grooves, thus being securely attached to the spoiler.

10 Claims, 8 Drawing Sheets

(58) Field of Classification Search
USPC ..... 343/713, 718, 720, 878, 716
See application file for complete search history.

(56) References Cited

U.S. PATENT DOCUMENTS

| | | | | |
|---|---|---|---|---|
| 2006/0082505 | A1* | 4/2006 | Baliarda | H01Q 1/36 343/700 MS |
| 2006/0267853 | A1 | 11/2006 | Naito | |
| 2007/0052590 | A1* | 3/2007 | Chang | H01Q 1/38 343/700 MS |
| 2008/0024304 | A1 | 1/2008 | Bergman et al. | |
| 2010/0095762 | A1 | 4/2010 | Despesse et al. | |
| 2010/0245189 | A1* | 9/2010 | Wang | H01Q 1/32 343/713 |
| 2012/0229351 | A1* | 9/2012 | Fellows | H01Q 5/35 343/702 |

FOREIGN PATENT DOCUMENTS

| | | | |
|---|---|---|---|
| CN | 101517601 | A | 8/2009 |
| CN | 102117957 | A | 7/2011 |
| CN | 102683793 | A | 9/2012 |
| EP | 1600336 | A1 | 11/2005 |
| EP | 2169764 | B1 | 7/2016 |
| JP | 09260916 | A | 10/1997 |
| JP | 2005341460 | A | 12/2005 |
| JP | 2008085757 | A | 4/2008 |
| JP | 2012065184 | A | 3/2012 |
| WO | 2008013876 | A1 | 1/2008 |

OTHER PUBLICATIONS

International Search Report corresponding to Application No. PCT/JP2014/053169; dated May 13, 2014, with English translation.

Written Opinion of the International Searching Authority corresponding to Application No. PCT/ JP2014/053169; dated May 13, 2014.

SIPO Second Office Action for corresponding Chinese Application No. 2014800188447; dated Sep. 14, 2017.

* cited by examiner

VEHICLE ATTACHED COMPONENT, AND ON-BOARD ANTENNA

CROSS REFERENCE TO RELATED APPLICATIONS

This is the U.S. national stage of application No. PCT/JP2014/053169, filed on Feb. 12, 2014. Priority under 35 U.S.C. § 119(a) and 35 U.S.C. § 365(b) is claimed from Japanese Application No. 2013-069661, filed Mar. 28, 2013, the disclosure of which is also incorporated herein by reference.

TECHNICAL FIELD

The present invention relates to vehicle accessories and vehicle-mounted antennas, as well as to structures for attaching an antenna element.

BACKGROUND ART

Spoiler antennas including an antenna element in a spoiler have been widely used as a vehicle-mounted antenna. Spoilers are accessories that are attached to the body of a vehicle, for regulating the flow of air surrounding the vehicle and for giving an aesthetic appearance to the vehicle. Spoilers include visor-shaped spoilers that are attached above the rear window of a vehicle, and wing-shaped spoilers that are attached at the rear of a vehicle. Typically, spoilers are formed by a hollow plastic resin, and an antenna element is attached to the inside of a spoiler.

Patent Document 1 identified below describes a spoiler antenna serving as a vehicle antenna device. The spoiler antenna is a spoiler that includes an antenna element formed by a conductor. A plurality of fixing components having insertion holes formed therein are disposed at predetermined positions on an inner surface of the spoiler. The antenna element is inserted through the insertion holes of the fixing components, and is fixed to the inside of the spoiler via the fixing components. Patent Document 1 also discloses a spoiler antenna having engagement tabs projecting from an inner wall of the spoiler in place of the fixing components. In this spoiler antenna, the antenna element is held in the engagement tabs, so that the antenna element is fixed to the spoiler.

Vehicle-mounted antennas further include other antennas such as antennas having an antenna element attached to the inside of a bumper that is formed by a hollow plastic resin, and antennas having an antenna element attached to an overhead console in the cabin.

CITATION LIST

Patent Literature

Patent Document 1: JP 2008-85757 A

SUMMARY OF INVENTION

Technical Problem

In most vehicle-mounted antennas that include an antenna element formed by a conductor, structures for fixing an antenna element at a certain position are formed in an accessory such as a spoiler or a bumper beforehand, and the antenna element is fixed to the accessory in a later step. In a spoiler antenna as disclosed in Patent Document 1, for example, the above-described fixing components or engagement tabs are formed on the spoiler beforehand, and the antenna element is fixed to the spoiler in the process of assembly of the spoiler or attachment of the spoiler to a vehicle.

Characteristics of an antenna that includes an antenna element formed by a conductor may be adjusted by changing the length, arrangement, or the like of the antenna element. However, it is difficult to adjust characteristics when structures for fixing an antenna element at a certain position are formed in an accessory. Additionally, partial fixing of an antenna element may cause loosening of the antenna element, and may cause noise during driving of the vehicle.

Objects of the present invention are to securely fix an antenna element, and to easily adjust characteristics of the antenna element.

Solution to Problem

According to one aspect of the present invention, there is provided a vehicle accessory that is attachable to a vehicle, the vehicle accessory comprising a groove on a surface, the groove forming a plurality of paths, wherein a conductor that forms an antenna element is disposed in one of the plurality of paths.

Further, in the vehicle accessory according to the present invention, it is preferable that the groove comprises a first-direction groove extending in a first direction, and a plurality of second-direction grooves extending in a second direction, the first-direction groove intersecting the plurality of second-direction grooves.

Further, in the vehicle accessory according to the present invention, it is preferable that the plurality of paths are in a grid pattern.

Further, it is preferable that the vehicle accessory according to the present invention further comprises a supporting component that is attachable to and detachable from the groove, wherein the conductor is supported by the supporting component.

Further, it is preferable that the vehicle accessory according to the present invention further comprises a tab that is provided from an edge of an opening of the groove, wherein the conductor disposed in the groove is held by the tab.

Further, it is preferable that the vehicle accessory according to the present invention further comprises a tube that covers the conductor, wherein a portion of the conductor covered by the tube is held by the tab.

Further, it is preferable that the vehicle accessory according to the present invention serves as a spoiler that is attachable to a vehicle.

According to another aspect of the present invention, there is provided a vehicle-mounted antenna comprising the vehicle accessory and the conductor.

Advantageous Effects of Invention

By employing the present invention, it is possible to securely fix an antenna element, and to easily adjust characteristics of the antenna element.

DESCRIPTION OF EMBODIMENTS

Figure 1:
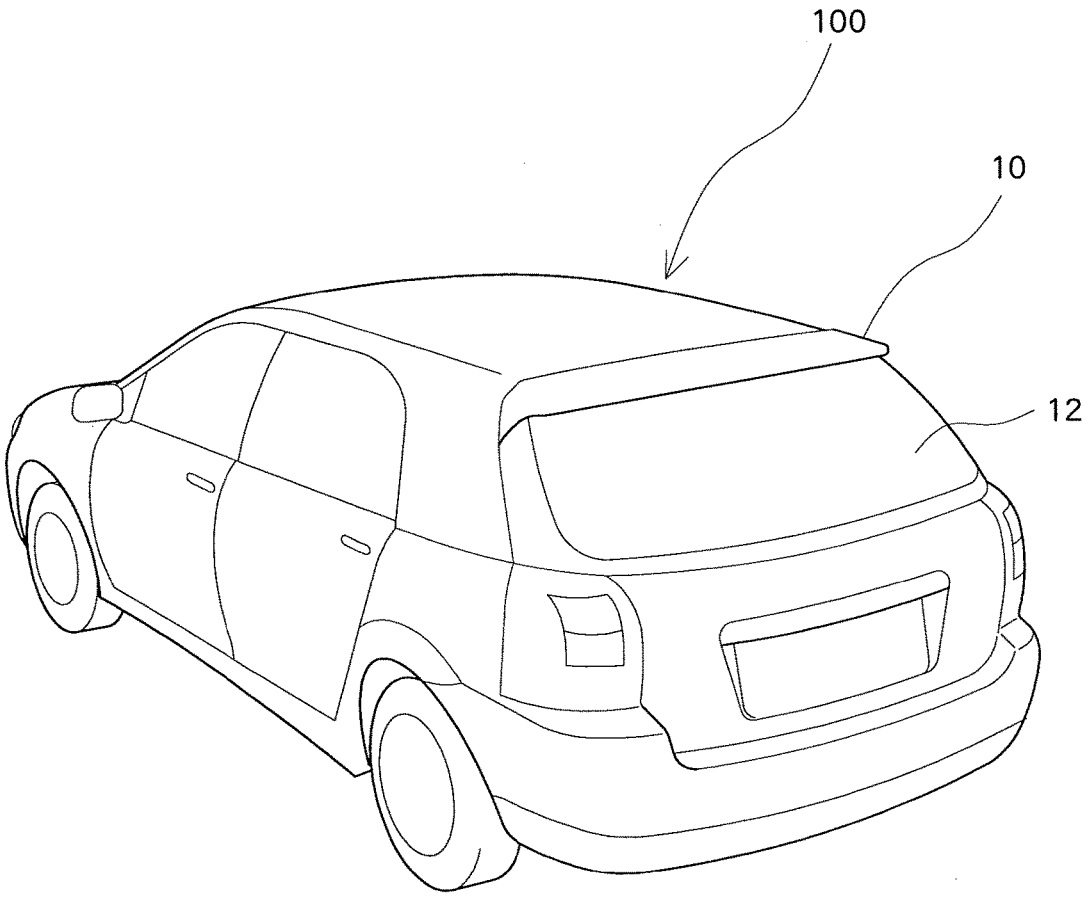
FIG. 1 illustrates a vehicle on which a spoiler is mounted.

FIG. 1 illustrates a vehicle 100. The vehicle 100 has a visor-shaped spoiler 10 disposed above a rear window 12. The spoiler 10 is a hollow exterior component made of, for example, a plastic resin, for regulating the flow of air surrounding the vehicle 100 and for giving an aesthetic appearance to the vehicle 100.

Figure 2:
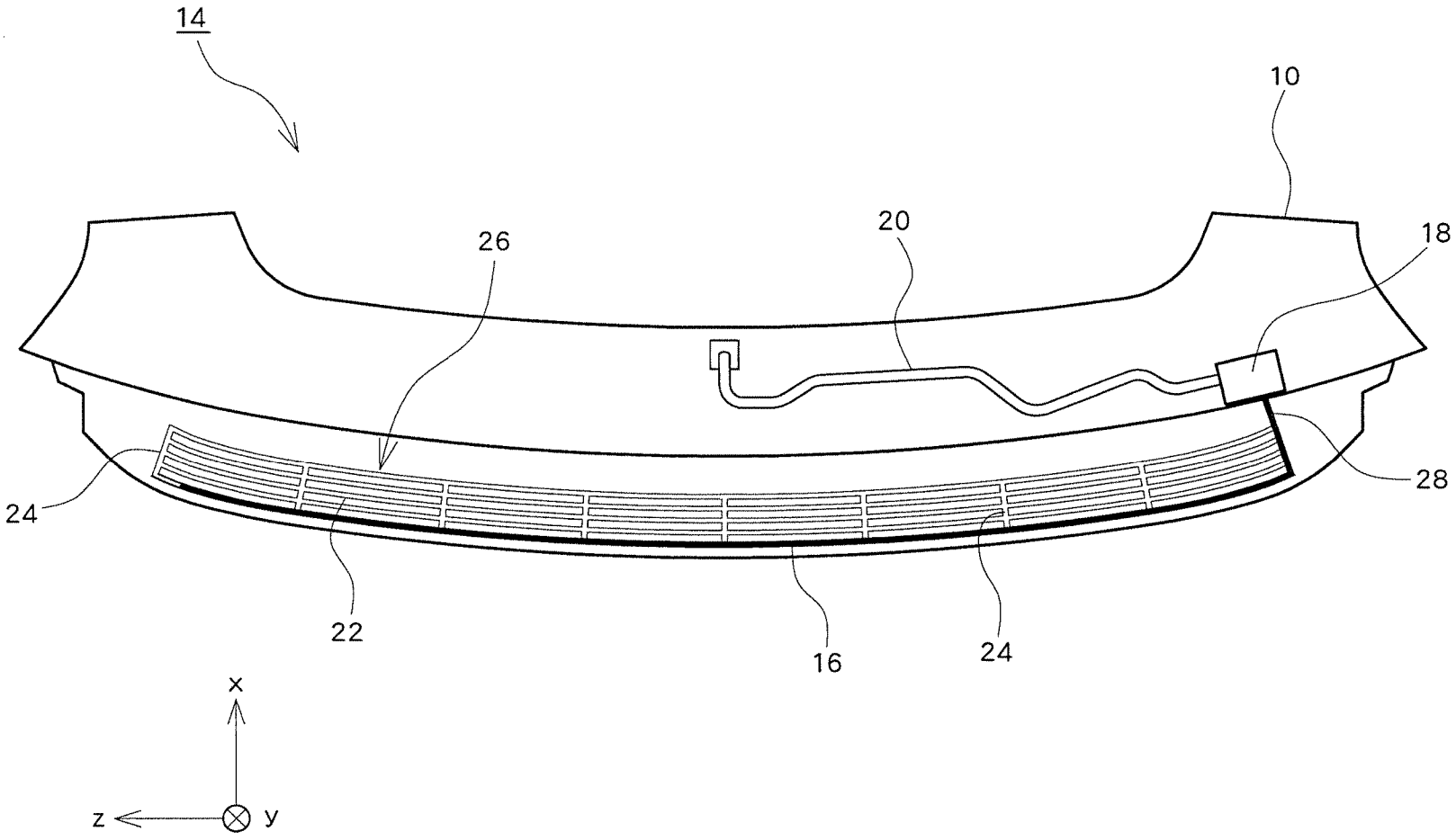
FIG. 2 illustrates a spoiler antenna according to an embodiment of the present invention.

FIG. 2 illustrates a spoiler antenna 14 according to an embodiment of the present invention. In FIG. 2, a cover plate is removed from the spoiler 10. In other words, FIG. 2 illustrates a bottom surface of the spoiler 10. The x-axis points to the front of the vehicle. The y-axis points vertically downward. The z-axis points to the left as viewed facing the front of the vehicle. The spoiler antenna 14 includes an antenna element 16, the spoiler 10, an amplifier 18, and a harness 20. The spoiler antenna 14 is used for, for example, an AM radio, an FM radio, a DAB (Digital Audio Broadcast) receiver, or a digital television receiver.

Figure 3:
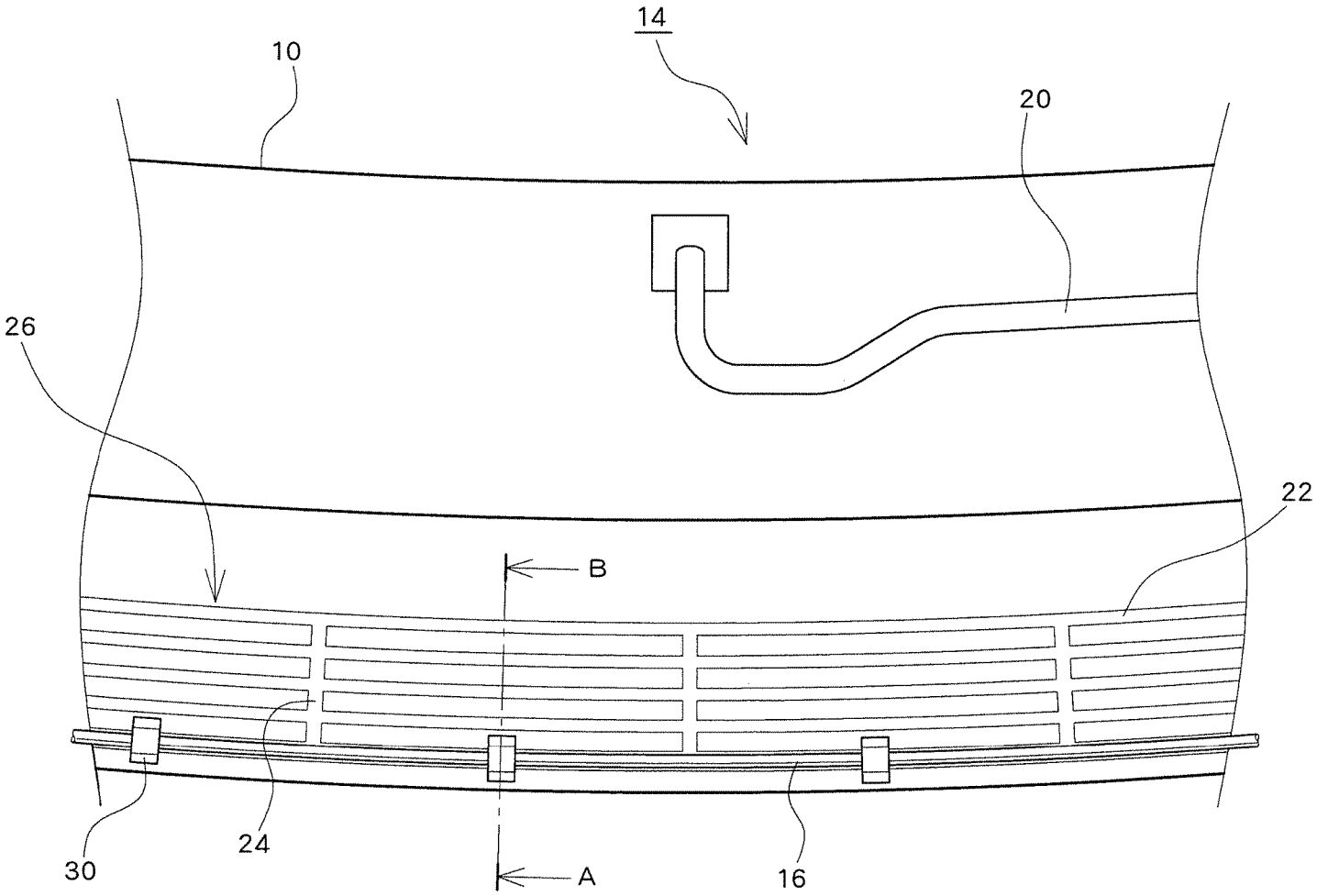
FIG. 3 is an enlarged view of a spoiler antenna.

A plurality of row grooves 22 extending in the side-to-side direction of the vehicle and a plurality of column grooves 24 extending in the fore-and-aft direction of the vehicle are formed in a rear portion of the spoiler 10. FIG. 2 illustrates an example in which five row grooves 22 and nine column grooves 24 are formed. FIG. 3 is an enlarged view of a portion of the spoiler 10 near the center. The plurality of row grooves 22 and the plurality of column grooves 24 form a grid pattern groove 26 that is a groove having a grid pattern in which the antenna element 16 is disposed.

As can be seen in FIG. 2, each row groove 22 connects between the leftmost column groove 24 and the rightmost column groove 24. Seven column grooves 24 are disposed between the right and left ends of the row grooves 22 at predetermined intervals, and intersect with the row grooves 22. A power supply groove 28 extends from the front end of the rightmost column groove 24 to the location at which the amplifier 18 is disposed.

The antenna element 16 is formed by a conductor. For example, a strand of a plurality of metal conductor wires or a single-wire metal conductor may be used as the conductor that forms the antenna element 16. The conductor that forms the antenna element 16 may be coated with an insulator.

The antenna element 16 has one end connected to the amplifier 18, and another end left open. The antenna element 16 is fitted into the power supply groove 28 and the grid pattern groove 26, and is fixed to the spoiler 10. In the example illustrated in FIG. 2, the antenna element 16 is fitted into a path extending from the amplifier 18 through the power supply groove 28 and the rightmost column groove 24 to the rear end of the rightmost column groove 24, and from there along the rearmost row groove 22 to near the leftmost column groove 24.

Figure 4:
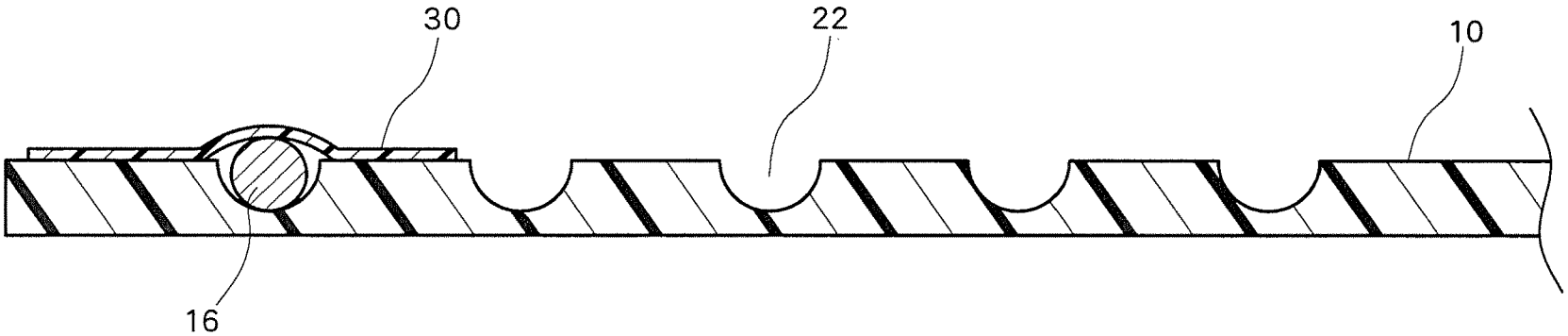
FIG. 4 is a cross-sectional view of a grid pattern groove.

FIG. 4 illustrates a cross-sectional view taken along line A-B of FIG. 3. The row grooves 22 are formed in a shape conforming to a surface of the antenna element 16. For example, when the antenna element 16 has a circular cross section, the row grooves 22 are formed to have an arc-shaped cross section. Although not illustrated in FIG. 4, the column grooves are also formed to have a cross-sectional shape conforming to the circumference of the antenna element 16.

As illustrated in FIGS. 3 and 4, the antenna element 16 is fixed using adhesive tape members 30 affixed at predetermined intervals in the longitudinal direction of the antenna element 16. In other words, the antenna element 16 is covered by the adhesive tape members 30 and fixed to the spoiler 10 with the antenna element 16 being fitted in the row grooves 22 or the column grooves 24.

Figure 5A:
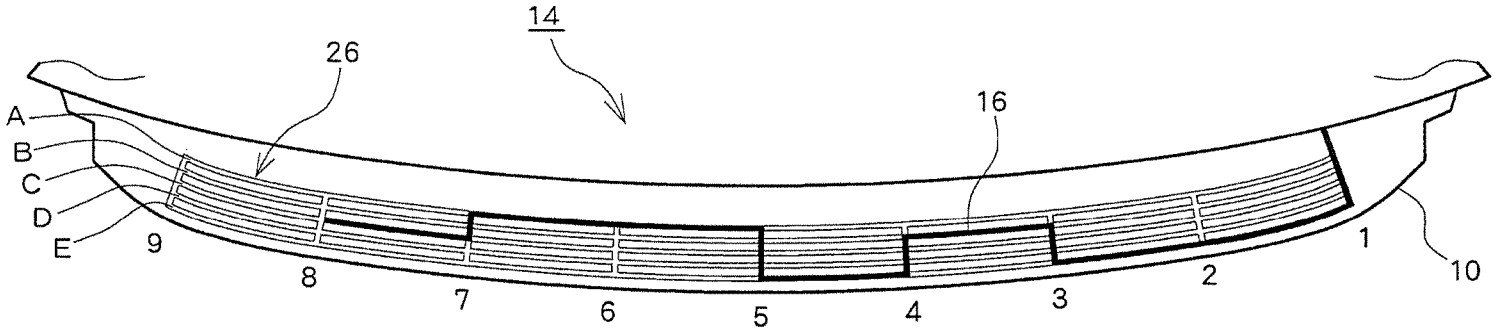
FIG. 5A-5C illustrates a plurality of different paths in which an antenna element may be disposed.
Figure 5B:
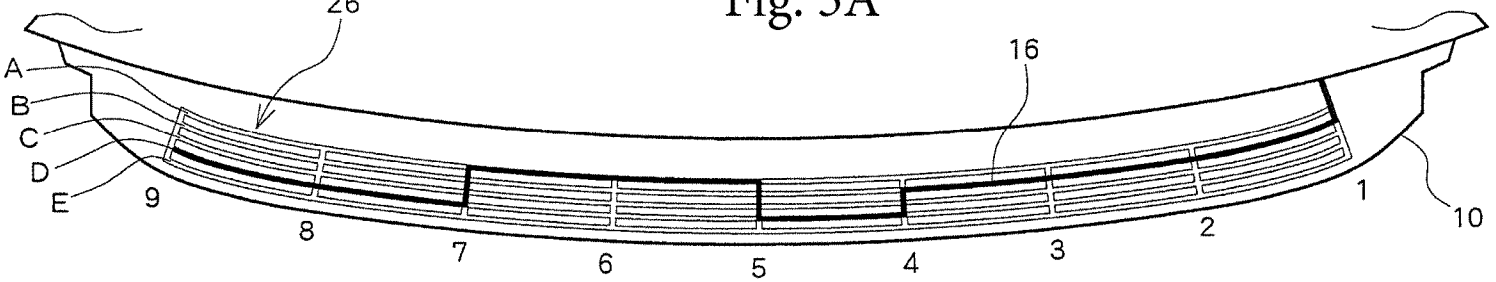
Figure 5C:
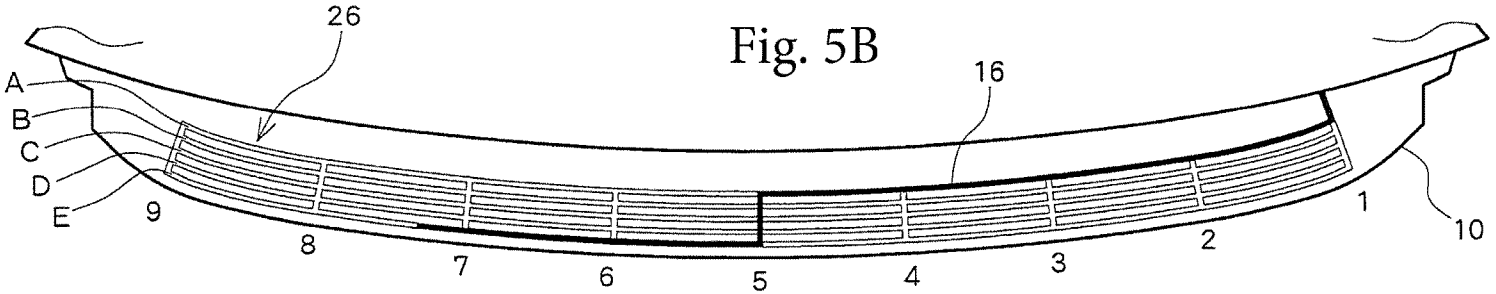

The grid pattern groove 26 forms a plurality of different paths in which an antenna element 16 may be disposed. FIGS. 5A to 5C illustrate a portion of the bottom surface of the spoiler 10 on which the grid pattern groove 26 is formed. The row grooves are denoted by reference numerals A to E sequentially from the front toward the rear. The column grooves are denoted by reference numerals 1 to 9 sequentially from the right toward the left.

In an example illustrated in FIG. 5A, an antenna element 16 is disposed in a path passing through the column groove 1, the row groove E, the column groove 3, the row groove B, the column groove 4, the row groove E, the column groove 5, the row groove A, the column groove 7, and the row groove C to a junction of the row groove C and the column groove 8. In an example illustrated in FIG. 5B, an antenna element 16 is disposed in a path passing through the column groove 1, the row groove B, the column groove 4, the row groove D, the column groove 5, the row groove A, the column groove 7, and the row groove D to a junction of the row groove D and the column groove 9. In an example illustrated in FIG. 5C, an antenna element 16 is disposed in a path passing through the column groove 1, the row groove A, the column groove 5, and the row groove E to a point in the row groove E between the column groove 7 and the column groove 8. The antenna elements 16 disposed in these paths have different shapes or lengths.

Among a plurality of different paths formed in the grid pattern groove 26, an antenna element 16 is disposed in a path that provides predetermined characteristics. Specifically, in the process of building a prototype of the spoiler antenna 14, characteristic adjustment (tuning) is performed in a manner described below. While the antenna element 16 is disposed in different paths, the characteristics of the spoiler antenna 14 are measured each time the path is changed, to determine a path that provides desired characteristics.

Returning to FIG. 2, other components of the spoiler antenna 14 will be described below. The amplifier 18 is fixed on the front side of the power supply groove 28. One end of the antenna element 16, which is fitted in the grid pattern groove 26 and the power supply groove 28, is connected to the amplifier 18. Further, the harness 20 is connected to the amplifier 18. The harness 20 is a bundle of a plurality of conductors, such as a signal line for transmitting signals that are received by the antenna element 16 and amplified by the amplifier 18, and a power supply line for supplying power supply electric power to the amplifier 18. The harness 20 passes through the inside of the spoiler 10, and is extended to the outside of the spoiler 10 to reach the inside of the vehicle. The signal line included in the harness 20 is connected to a receiver disposed in the vehicle, and the power supply line included in the harness 20 is connected to a power supply device disposed in the vehicle.

By employing the above-described structure, the antenna element 16 is fitted into the power supply groove 28 and the grid pattern groove 26, and is fixed to the spoiler 10. As a result, a surface of the antenna element 16 is supported by the spoiler 10 over a large area, and the antenna element 16 is securely fixed to the spoiler 10. Further, a plurality of different paths through which the antenna element 16 may be disposed are formed in the grid pattern groove 26. As a result, the shape or length of the antenna element 16 can be easily changed, and characteristics can be easily adjusted.

The groove in which the antenna element 16 is disposed may also be in a pattern other than a grid pattern. For example, a plurality of grooves having freely chosen shapes that are connected to the power supply groove 28 may be provided to thereby form a plurality of different paths through which the antenna element 16 may be disposed. Further, the longitudinal direction of the grooves is not limited to the fore-and-aft direction or the transverse direction of the vehicle, and may be inclined with respect to the fore-and-aft direction of the vehicle.

Figure 6:
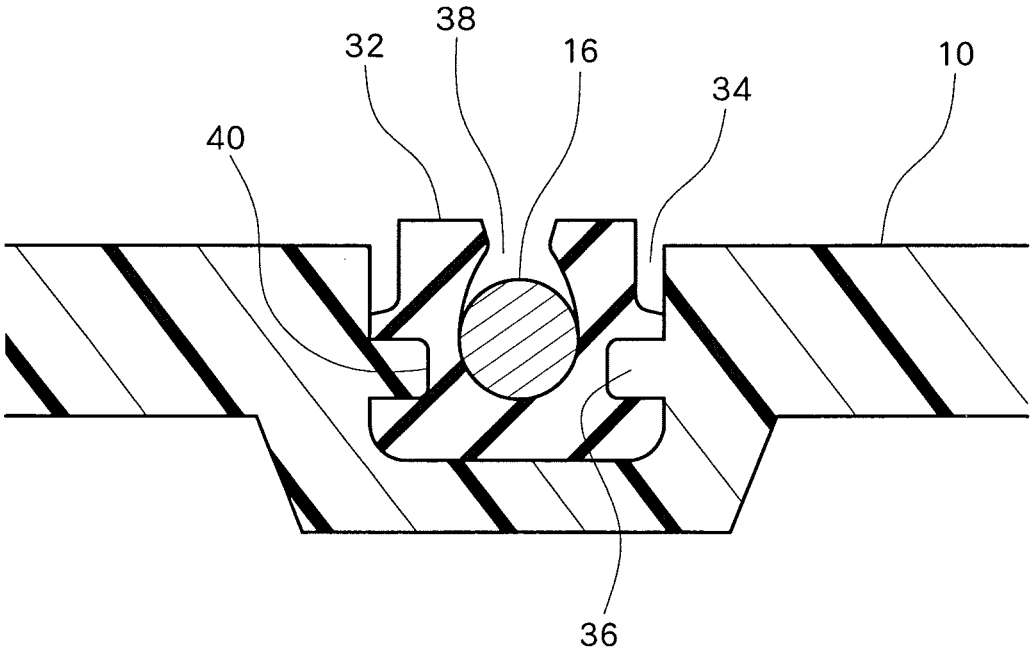
FIG. 6 is a cross-sectional view illustrating a structure that allows an antenna element to be fixed to a spoiler.
Figure 7:
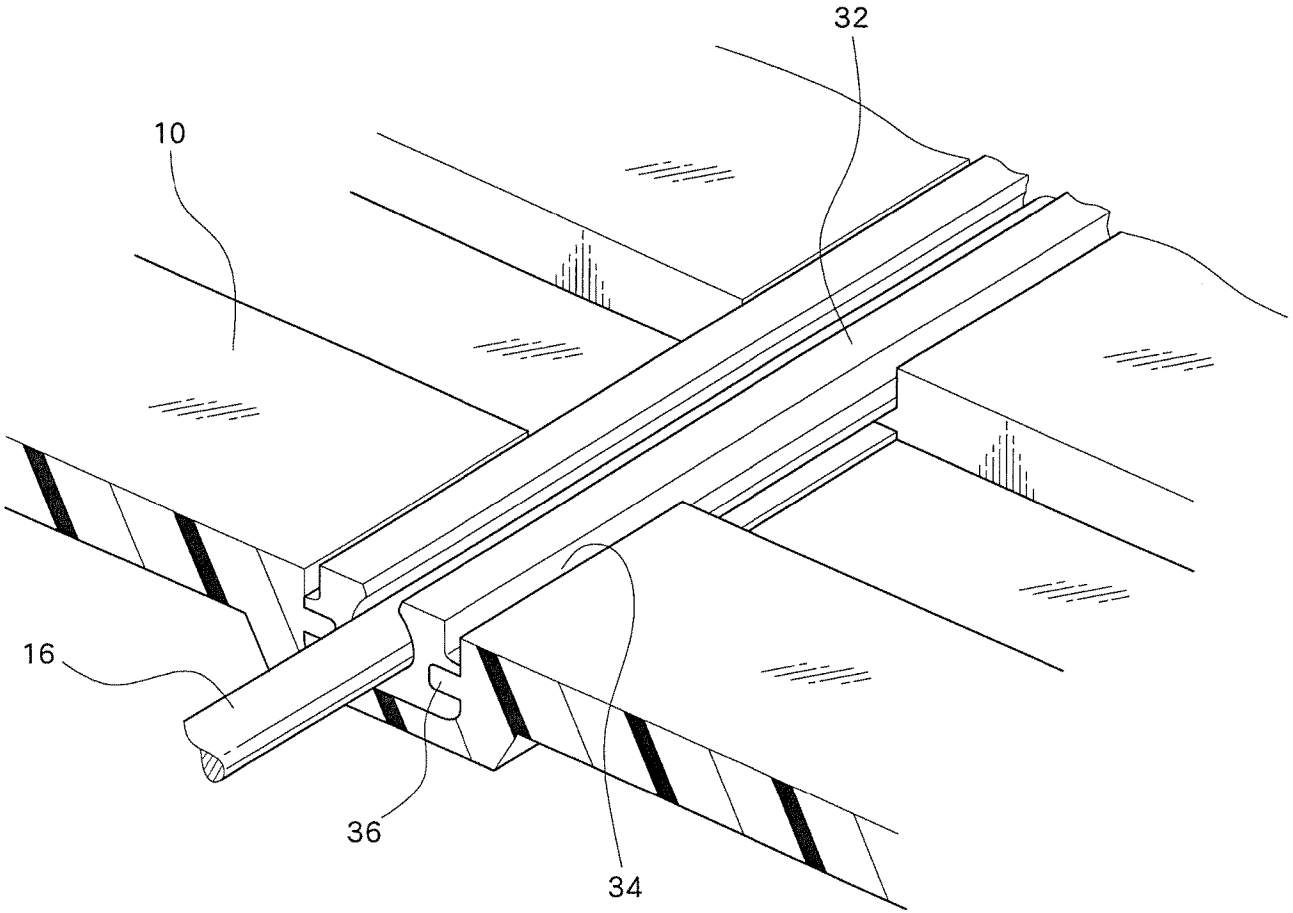
FIG. 7 is a perspective view illustrating a structure that allows an antenna element to be fixed to a spoiler.

As a component for fixing the antenna element in grooves of the spoiler, a supporting component formed from an elastic material may be used. FIG. 6 illustrates a cross-sectional view of the antenna element 16, the spoiler 10, and a supporting component 32. Further, FIG. 7 illustrates a perspective view of these components. A groove 34 formed in the spoiler 10 corresponds to one of the above-described row or column grooves.

The groove 34 formed in the spoiler 10 has protrusions 36 for fixing the supporting component 32. The protrusions 36 may be shaped like an embankment extending along the groove 34. The supporting component 32 is linearly formed from an elastic material such as rubber. The supporting component 32 has a supporting groove 38 and engagement grooves 40 extending in the longitudinal direction of the supporting component 32. The supporting groove 38 supports the antenna element 16, and the engagement grooves 40 engage with the protrusions 36 from the groove 34 in the spoiler 10. By forming the supporting component 32 from an elastic material, the supporting component 32 can be attached to and detached from the groove 34 as desired.

The supporting component 32 does not have to be provided over all segments of the groove 34 along which the antenna element 16 is present. In other words, the supporting component 32 may be provided only in a certain segment of the groove 34. After the supporting component 32 is fitted into the groove 34 of the spoiler 10, the antenna element 16 is fitted into the supporting component 32. As a result, the antenna element 16 is fixed to the spoiler 10 with the supporting component 32 being interposed therebetween.

By employing the above-described structure, the surface of the antenna element 16 is supported by the supporting component 32 over a large area. As a result, the antenna element 16 is securely fixed to the spoiler 10. Further, because the supporting component 32 can be attached to and detached from the groove 34 as desired, the process of repeatedly changing the position of the supporting component 32 is easy. As a result, the characteristics of the spoiler antenna can be easily adjusted.

Figure 8:
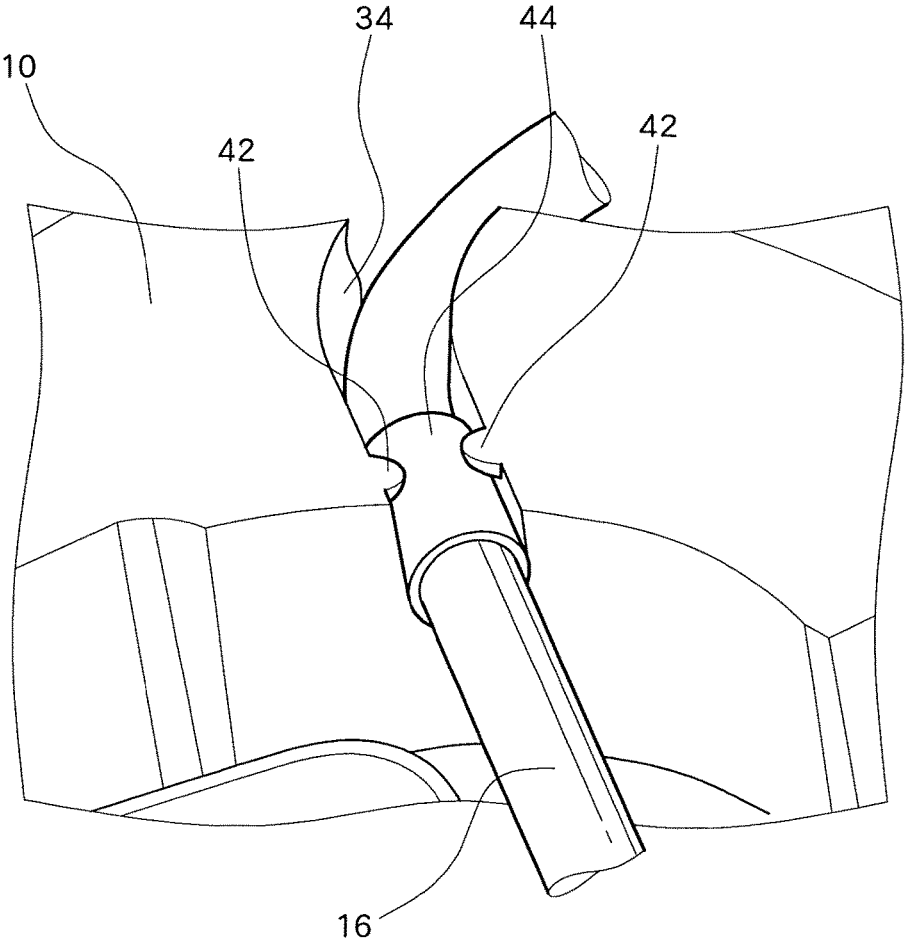
FIG. 8 illustrates a structure including tabs that are formed on a groove of a spoiler to fix an antenna element in the groove.

Tabs may also be formed from grooves of a spoiler to fix an antenna element in the grooves. FIG. 8 illustrates a structure wherein the antenna element 16 is fixed in the groove 34 using tabs 42. As can be seen in FIG. 8, a pair of opposing tabs 42 are provided from opposing edges of an opening of the groove 34. A portion of the antenna element 16 is covered by a tube 44 formed from an elastic material such as rubber. The antenna element 16 fitted into the groove 34 is fixed in the groove 34 with the tabs 42 holding the portion covered by the tube 44. When the tube 44 formed from an elastic material is used, the tube 44 exerts an elastic force on the antenna element 16 and securely fixes the antenna element 16 in the groove 34. Further, the material for forming the tube 44 or the shape of the tube 44 may be determined such that the antenna element 16 can be attached to and detached from the groove 34 as desired.

By employing the above-described structure, the antenna element 16 is securely fixed to the spoiler 10, as with the structure in which the supporting component is used. Further, when the antenna element 16 can be attached to and detached from the groove 34 as desired, characteristics of the spoiler antenna can be easily adjusted.

In the above-described examples, the present invention is used for spoiler antennas. The present invention may also be used for antennas including an antenna element fixed to a bumper, a console, or another accessory. Further, the present invention may be used not only for receiver antennas, but also for transmitter antennas or transceiver antennas. For example, the present invention may be used for a transceiver that supports LTE (Long Term Evolution).

The invention claimed is:

1. An antenna system for use with a vehicle, the antenna system comprising:

an accessory panel structures to be mounted on the vehicle;

a plurality of grooves formed into a surface of the accessory panel, at least two grooves of the plurality of grooves intersecting each other, and the plurality of grooves defining a plurality of paths;

an antenna structures to receive signals;

a; and wherein each of the plurality of grooves is structures to receive the antenna therein;

wherein the antenna is provided in at least one the plurality of grooves such that the antenna is disposed in one of the plurality of paths; and the plurality of paths are configured such that antenna characteristics of the antenna vary based on which path of the plurality of paths the antenna is disposed in.

2. The antenna system according to claim 1, wherein the plurality of grooves comprises a first-direction groove extending in a first direction, and a plurality of second-direction grooves extending in a second direction, the first-direction groove intersecting the plurality of second-direction grooves.

3. The antenna system according to claim 1, wherein the plurality of paths are in a grid pattern.

4. The antenna system according to claim 1, further comprising a supporting component that is attachable to and detachable from the plurality of grooves, wherein the antenna is supported by the supporting component.

5. The antenna system according to claim 1, further comprising a tab that is provided from an edge of an opening of the plurality of grooves, wherein the antenna disposed in the groove is held by the tab.

6. The antenna system according to claim 5, further comprising a tube that covers the antenna, wherein a portion of the conductor covered by the tube is held by the tab.

7. The antenna system according to claim 1, wherein the accessory panel is part of a spoiler to be attached to the vehicle.

8. The antenna system according to claim 1, wherein the antenna comprises a conductor.

9. The antenna system according to claim 1, wherein the antenna comprises a wire or plurality of wires.

10. The antenna system according to claim 1 further comprising an amplifier;

wherein a first end of the antenna is connected to the amplifier; and a second end of the antenna is left open.

* * * * *